US005836565A

United States Patent [19]

Chang

[11] Patent Number: 5,836,565

[45] Date of Patent: Nov. 17, 1998

[54] SUPPORTING DEVICE FOR A PICTURE FRAME

[76] Inventor: Yao-ming Chang, No. 40, Lane 40, Sec. 3, Chungyang N, Rd., Peitou Dist., Taipei, Taiwan

[21] Appl. No.: 789,655

[22] Filed: Jan. 27, 1997

[51] Int. Cl.[6] ..... A47G 1/24

[52] U.S. Cl. ..... 248/456; 40/748; 40/761; 248/470

[58] Field of Search ..... 248/470, 471, 248/456, 457, 469, 454; 40/748, 749, 761, 762

[56] References Cited

U.S. PATENT DOCUMENTS

| | | | |
|---|---|---|---|
| 270,130 | 1/1883 | Roeder | 248/470 |
| 1,513,027 | 10/1924 | Belli | 40/762 X |
| 3,990,670 | 11/1976 | Frechtman | 248/470 |
| 4,216,936 | 8/1980 | DeSelms | 40/762 X |
| 4,939,858 | 7/1990 | Dailey | 40/762 X |
| 5,253,440 | 10/1993 | Chang | 40/748 |

FOREIGN PATENT DOCUMENTS

| | | | |
|---|---|---|---|
| 25327 | 3/1883 | Germany | 248/470 |
| 516911 | 1/1940 | United Kingdom | 248/470 |

*Primary Examiner*—Ramon O. Ramirez
*Attorney, Agent, or Firm*—Hedman, Gibson & Costigan, P.C.

[57] ABSTRACT

A supporting device for a picture frame comprises a mount adapted to be securely attached to a picture frame back and a support piece. The mount has one or more pairs of opposite sides defined on a periphery thereof. The support piece is selectably received in a selected pair of holes in corresponding pair of opposite sides of the mount. Depending on which pair of holes is selected to receive the support piece, the support piece is adaptable to picture frames of different sizes.

11 Claims, 4 Drawing Sheets

SUPPORTING DEVICE FOR A PICTURE FRAME

BACKGROUND OF THE INVENTION

The present invention relates to a supporting device for a picture frame.

A conventional supporting device is specifically shown in the picture frame of FIG. 5. In this prior picture frame, the supporting device 30 supports a frame body 40 at a given inclination. The supporting device 30 comprises a frame back 31 and a support piece 32. The frame back 31 and the support piece 32 are interconnected by a hinge mechanism 33 provided therebetween. The frame back 31 is suitably placed within a central stepped hole 41 formed at a rear of the frame body 40 and is then retained in position by a number of fingers 42. As is known, a picture or the like can be disposed within the stepped hole 41 between the frame body 40 and the frame back 31.

In the above-described prior art design, the support piece 32 has two sides 322 and 324. In the figure shown, the side 322 rests on a support plane, for example a table, and the inclination of the picture frame is determined by the inherent design of the hinge mechanism 33 and the fixed size or length of the support piece 32. Under this design, the inclination of the support piece 32 relative to the frame back 31 is fixed, i.e., cannot be altered.

It is possible to rotate the picture frame 40 by 90 (ninety) degrees and then employ the other side 324 as a support end. However, due to this ability of changing to a desired supporting side, the support piece 32 is inclinedly hinged to the frame back 31 such that its supporting stability is sacrificed or reduced. Moreover, the design of the supporting device 30 cannot be hung on a wall.

The present invention aims at improving the above type of picture frame by providing a supporting device used for a picture frame which provides a firm support and is adjustable to be adapted to picture frames of different sizes.

BRIEF SUMMARY OF THE INVENTION

In accordance with the present invention, a supporting device for a picture frame includes a mount, a frame back, and a support piece. The mount has one or more pairs of opposite sides defined on a periphery thereof and may be attached to or integrally formed with the frame back. The support piece includes a pair of legs with an intermediate beam extending therebetween. Each leg has a terminal portion pivotably received in a respective one of a plurality of holes defined in opposite sides of the mount. A frame body defines a stepped hole into which the frame back is received.

Each of the pair of legs is selectably attached onto a corresponding one of a selective pair of opposite sides of the mount to maintain the support piece at a predetermined inclination with respect to the mount.

Other objects, advantages and novel features of the invention will become more apparent from the following detailed description when taken in conjunction with the accompanying drawings.

DETAILED DESCRIPTION OF THE INVENTION

Figure 1:
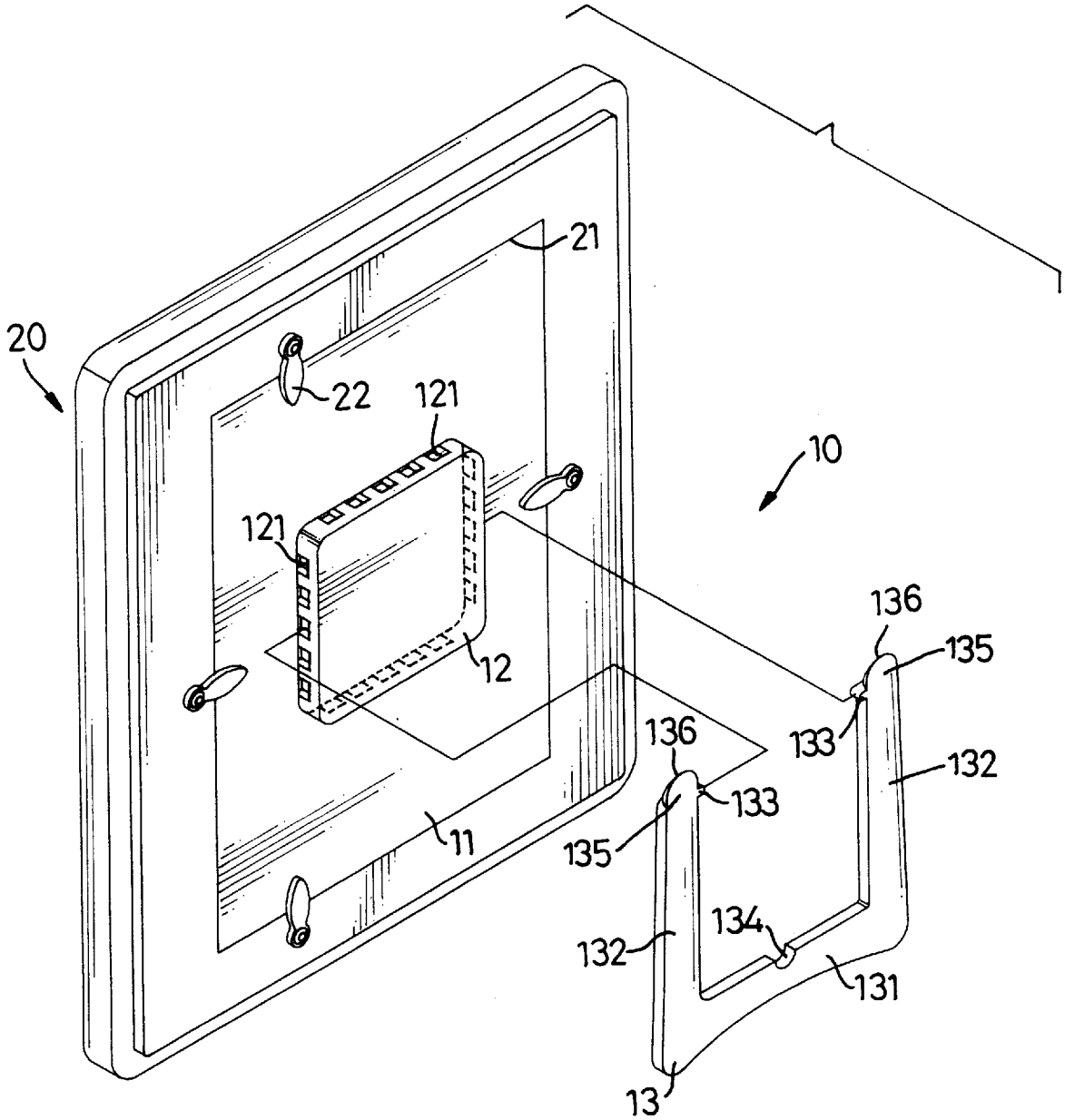
FIG. 1 is a perspective view of a picture frame incorporating a supporting device, in disassembled form, in accordance with the present invention.

Referring initially to FIG. 1, a supporting device 10 in accordance with the present invention comprises a mount 12 and a support piece 13. The mount 12 is adapted to be securely attached, such as by gluing, to a frame back 11 of a picture frame 20. Alternatively, the mount 12 may be integrally formed with the frame back 11 during manufacturing, such as by injection molding. The picture frame 20 is generally of a conventional design which has a frame body defining an inner stepped periphery 21 for receiving the frame back 11 and a number of fingers 22. As mentioned, the frame back 11, made of wood or plastics or any other suitable material, may be integrally formed with the mount 12 or be separately made. The mount 12 has one or more pairs of opposite sides defined on a periphery thereof. In the figure shown, the mount 12 has a substantially rectangular periphery and there are two pairs of opposite sides. It is contemplated that a polygonal periphery is possible and in this case the outer periphery of the frame body is similarly polygonal.

The support piece 13 has a pair of legs 132 and an intermediate beam 131 interconnecting the pair of legs 132. Each leg 132 has a terminal portion 135.

To attach each of the pair of legs 132 onto a corresponding one of a selective pair of opposite sides of the mount 12, there is one or more holes 121 (five in the drawing shown) provided on each of the one or more opposite sides of the mount 12 and a respective tab 133 formed on each leg 132. The legs 132 are selectively engageable into respective holes of a corresponding pair of opposite sides.

Figure 2:
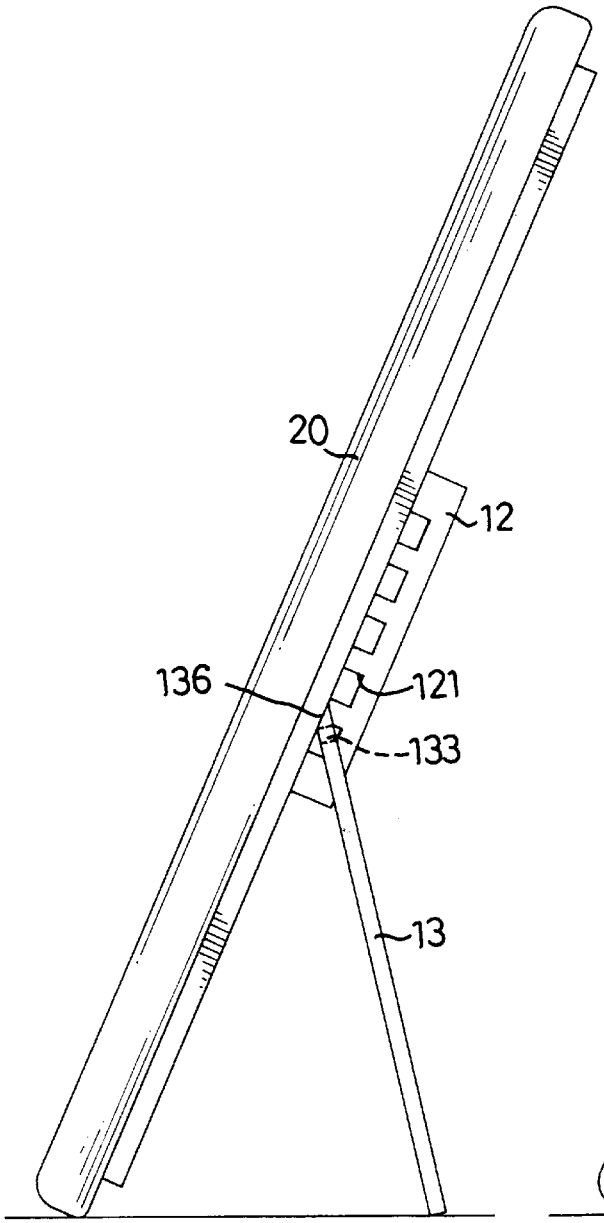
FIG. 2 is a side view showing that the supporting device, in a first assembled position, supports a frame body.
Figure 3:
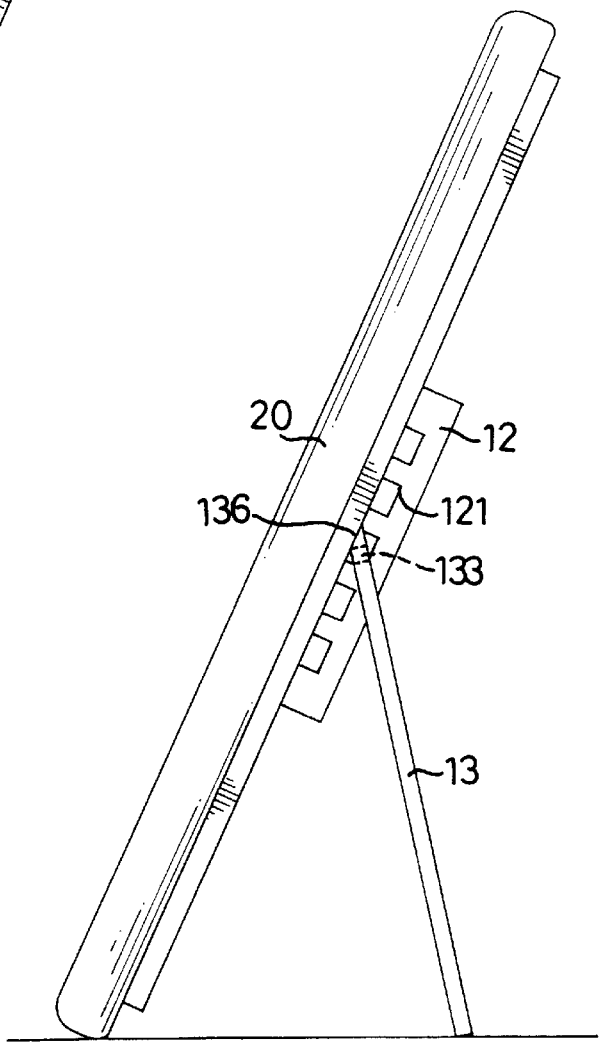
FIG. 3 is a view similar to FIG. 2 but showing that the supporting device, in a second assembled position, supports a frame body of a different size.

In particular, as is clearly shown in FIGS. 2 and 3, each leg 132 has a terminal portion 136 and the tab 133 of each leg 132 has a substantially rectangular cross-section. As shown, the end of the terminal portion is may be chamfered to provide a flat face. Similarly, each hole 121 on each side of the mount 12 is substantially rectangular. When the support piece 13 is extended to be at a predetermined inclination relative to the frame back 11, the chamfered end of the terminal portion 136 of each leg 132 abuts a surface of the picture frame back and an edge of the tab 133 of each leg 132 abuts a wall surface of the rectangular hole 121. With this arrangement, the support piece 13 is selectably attached to, and then maintained at a predetermined inclination with respect to, the mount 12.

FIGS. 2 and 3 respectively show a large frame 20 and a small frame 20 each supported at a same angle but with respective support pieces 13 received in different holes 121.

Figure 4:
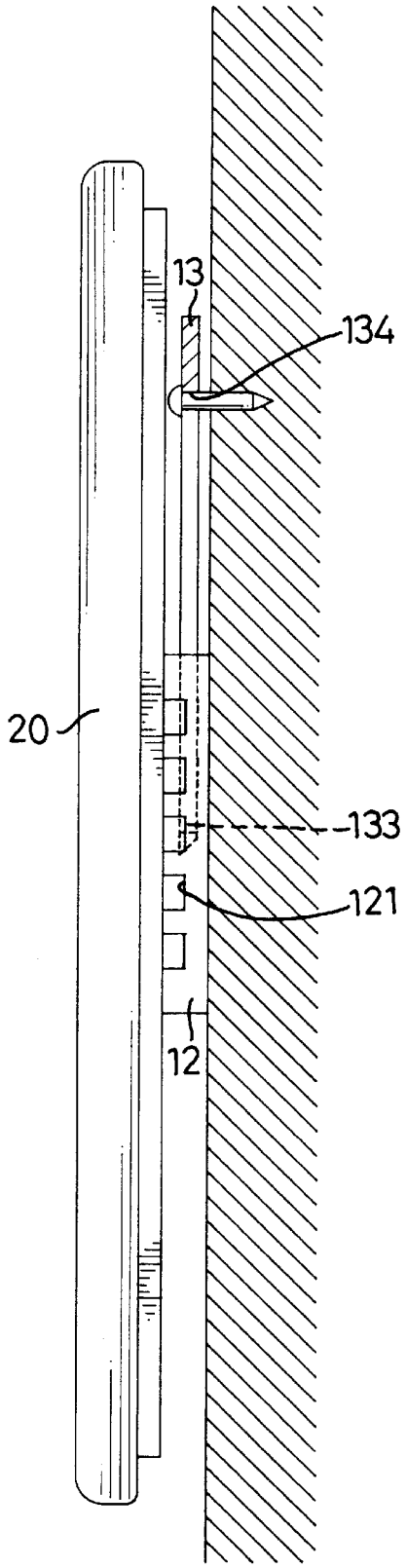
FIG. 4 shows that the picture frame hangs to a wall by way of the supporting device of the invention.
Figure 5:
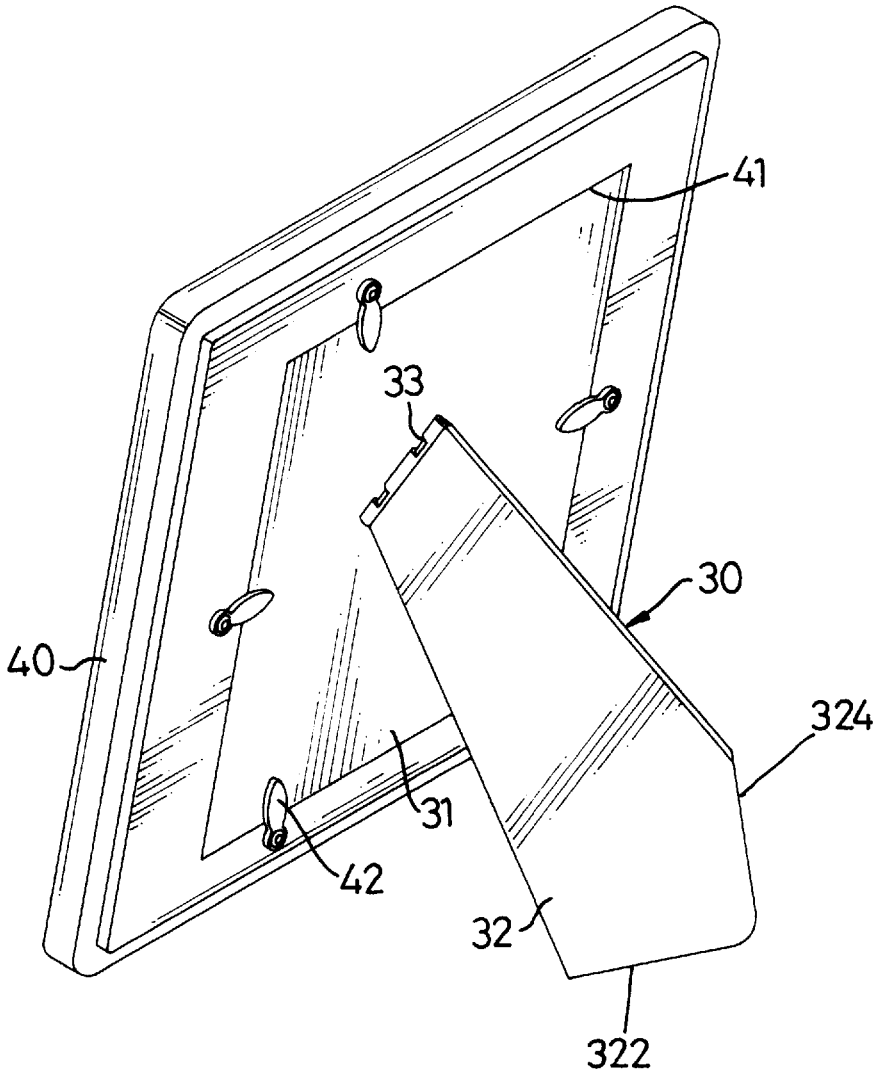
FIG. 5 PRIOR ART
FIG. 5 shows a conventional picture frame and supporting piece construction.

Referring again to FIG. 1 and further to FIG. 4, the intermediate beam 134 has a notch 134 for hanging the support piece 13 to a wall by means of a nail, etc. Alternatively, the notch may be replaced by a hole extending through the intermediate beam 134.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A supporting device for a picture frame, comprising:

a mount adapted to be securely attached to a picture frame back, the mount having one or more pairs of opposite sides defined on a periphery thereof;

a support piece having a pair of legs and an intermediate beam interconnecting the pair of legs, each leg having a terminal portion; and means for selectably attaching each of the pair of legs onto a corresponding one of a selected pair of opposite sides of the mount to maintain the support piece at a predetermined inclination with respect to the mount, wherein the means for attaching comprises one or more holes in each of the one or more opposite sides of the mount and a respective tab on each leg selectively engageable into a respective hole of a corresponding one of each pair of opposite sides, and further wherein the tab of each leg has a substantially rectangular cross-section, each hole on each side of the mount is substantially rectangular, an end of the terminal portion of each leg abuts a surface of the picture frame back and an edge of the tab of each leg abuts a wall surface of the rectangular hole when the support piece is at the predetermined inclination.

2. The supporting device as claimed in claim 1, further comprising a picture frame back integral with the mount.

3. The supporting device as claimed in claim 2, wherein the mount has a substantially rectangular periphery.

4. The supporting device as claimed in claim 2, wherein the intermediate beam further comprises means for hanging the support piece to a wall.

5. The supporting device as claimed in claim 4, wherein the means for hanging is a notch in the intermediate beam.

6. The supporting device as claimed in claim 1, wherein the end of the terminal portion is chamfered.

7. A picture frame comprising:

a frame body having a central stepped hole; and a supporting device comprising a frame back mounted within the central stepped hole, a mount connected with the frame back, the mount having one or more pairs of opposite sides defined on an outer periphery thereof, a support piece having a pair of legs and an intermediate beam interconnecting the pair of legs, and means for selectably attaching each of the pair of legs onto a corresponding one of a selected pair of opposite sides of the mount to maintain the support piece at a predetermined inclination with respect to the mount, wherein the means for attaching comprises one or more holes in each of the one or more opposite sides of the mount and a respective tab on each leg selectively engageable into a respective hole of a corresponding one of each pair of opposite sides, and further wherein each leg has a terminal portion, the tab of each leg is substantially rectangular, each hole on each side of the mount is substantially rectangular, and an end of the terminal portion of each leg abuts a surface of the picture frame back and an edge of the tab of each leg abuts a wall surface of the rectangular hole when the support piece is at the predetermined inclination.

8. The supporting device as claimed in claim 7, wherein the mount has a substantially rectangular outer periphery.

9. The supporting device as claimed in claim 7, wherein the intermediate beam further comprises means for hanging the support piece to a wall.

10. The supporting device as claimed in claim 9, wherein the means for hanging is a notch in the intermediate beam.

11. The supporting device as claimed in claim 7, wherein the end of the terminal portion is chamfered.

* * * * *